US009960025B1

(12) United States Patent
Hughes

(10) Patent No.: US 9,960,025 B1
(45) Date of Patent: May 1, 2018

(54) COLD-MATTER SYSTEM HAVING ION PUMP INTEGRATED WITH CHANNEL CELL

(71) Applicant: ColdQuanta, Inc., Boulder, CO (US)

(72) Inventor: Steven Michael Hughes, Louisville, CO (US)

(73) Assignee: ColdQuanta Inc., Boulder, CO (US)

( * ) Notice: Subject to any disclaimer, the term of this patent is extended or adjusted under 35 U.S.C. 154(b) by 663 days.

(21) Appl. No.: 14/538,568

(22) Filed: Nov. 11, 2014

Related U.S. Application Data

(63) Continuation-in-part of application No. 14/466,711, filed on Aug. 22, 2014.
(Continued)

(51) Int. Cl.
*H01J 41/12* (2006.01)
*F04B 37/04* (2006.01)
*F04B 37/14* (2006.01)

(52) U.S. Cl.
CPC ..... *H01J 41/12* (2013.01); *F04B 37/04* (2013.01); *F04B 37/14* (2013.01)

(58) Field of Classification Search
CPC ..... F04B 37/14; F04B 37/00; F04B 37/02; F04B 37/04; H02K 44/00–44/06; G21K 1/006; H05H 3/02; H01J 41/12–41/20
(Continued)

(56) References Cited

U.S. PATENT DOCUMENTS 2,967,257 A * 1/1961 Milleron ..... H01J 41/20 313/161
2,993,638 A * 7/1961 Helmer ..... H01J 41/06 315/111.01
(Continued)

FOREIGN PATENT DOCUMENTS

EP 0106377 B1 11/1988
EP 1267385 A1 12/2002
(Continued)

OTHER PUBLICATIONS

P. Cheney et al., "A Zeeman slower design with permanent magnets in a Halbach configuration" Review of Scientific Instruments, 82, 2011.
(Continued)

*Primary Examiner* — Alexander Comley
(74) *Attorney, Agent, or Firm* — Clifton Leon Anderson

(57) ABSTRACT

A cold-atom cell is formed by machining a block of silicon to define sites for an atom source chamber, an atom manipulation chamber, and an ion-pump chamber. A polished silicon panel is frit-bonded to an unpolished (due to machining) chamber wall (which would be difficult and costly to polish). The polished panel can then serve as a reflector or a sight for anodic bonding. A solid-phase atom source provides for vapor phase atoms in the source chamber. The source chamber also includes carbon and gold to regulate the atom pressure by sorbing and desorbing thermal atoms. The atom manipulation chamber includes components for magneto-optical trap and an atom chip, e.g., for forming a Bose-Einstein condensate. The ion-pump chamber serves as the site for an ion pump. By integrating the ion pump into the body of the cold-atom cell, a more compact, reliable, and robust cold-atom cell is achieved. In addition to the embodiment just described, several variations and alternatives are presented and within the scope of the claims.

4 Claims, 8 Drawing Sheets

Related U.S. Application Data

(60) Provisional application No. 61/902,665, filed on Nov. 11, 2013.

(58) Field of Classification Search
USPC ..... 29/888.02; 417/48, 49; 250/251
See application file for complete search history.

(56) References Cited

U.S. PATENT DOCUMENTS

| | | | | | |
|---|---|---|---|---|---|
| 3,156,406 | A * | 11/1964 | Lloyd | F04F 9/00 | 417/49 |
| 3,398,879 | A | 8/1968 | James et al. | | |
| 3,460,745 | A * | 8/1969 | Lamont, Jr. | H01J 41/20 | 313/7 |
| 3,486,213 | A * | 12/1969 | Maliakal | H01J 41/16 | 29/402.01 |
| 3,755,704 | A | 8/1973 | Spindt et al. | | |
| 4,097,195 | A * | 6/1978 | Hill | H01J 41/20 | 313/553 |
| 4,594,054 | A * | 6/1986 | Ishimaru | H01J 41/18 | 417/49 |
| 5,256,995 | A | 10/1993 | Scholes | | |
| 6,004,104 | A * | 12/1999 | Rutherford | H01J 41/14 | 417/49 |
| 6,109,880 | A * | 8/2000 | Krueger | F04B 37/02 | 417/48 |
| 6,142,742 | A * | 11/2000 | Krueger | C23C 14/564 | 417/48 |
| 7,126,112 | B2 | 10/2006 | Anderson et al. | | |
| 7,470,971 | B2 * | 12/2008 | McBride | B81C 3/001 | 257/613 |
| 7,494,326 | B2 | 2/2009 | Bonne | | |
| 7,807,509 | B2 | 10/2010 | McBride | | |
| 7,811,421 | B2 | 10/2010 | Chistyakov | | |
| 7,850,432 | B2 * | 12/2010 | Clough | F04B 37/02 | 250/437 |
| 7,955,551 | B2 | 6/2011 | McBride et al. | | |
| 77,955,551 | | 6/2011 | McBride et al. | | |
| 8,309,909 | B2 * | 11/2012 | Dikovsky | G04F 5/14 | 250/251 |
| 8,405,021 | B2 | 3/2013 | Anderson et al. | | |
| 8,415,612 | B2 | 4/2013 | McBride et al. | | |
| 8,439,649 | B2 * | 5/2013 | Rutherford | H01J 41/20 | 313/231.01 |
| 9,117,563 | B2 * | 8/2015 | Hughes | G21K 1/006 | |
| 2002/0185947 | A1 * | 12/2002 | Schulte | F04B 17/00 | 313/7 |
| 2005/0199871 | A1 * | 9/2005 | Anderson | G21K 1/006 | 257/14 |
| 2006/0169882 | A1 * | 8/2006 | Pau | G21K 1/003 | 250/281 |
| 2007/0286738 | A1 * | 12/2007 | Lukens | F04B 37/02 | 417/49 |
| 2009/0212204 | A1 * | 8/2009 | McBride | H05H 3/02 | 250/251 |
| 2009/0321719 | A1 * | 12/2009 | Folman | B82Y 10/00 | 257/25 |
| 2010/0200739 | A1 * | 8/2010 | Anderson | G21K 1/006 | 250/251 |
| 2010/0207016 | A1 * | 8/2010 | McBride | G21K 1/00 | 250/251 |
| 2012/0039689 | A1 | 2/2012 | Touchberry et al. | | |
| 2012/0258022 | A1 * | 10/2012 | Hughes | C03B 32/00 | 422/291 |

FOREIGN PATENT DOCUMENTS

| | | | |
|---|---|---|---|
| EP | 1733414 | B1 | 12/2006 |
| EP | 2151849 | A1 | 2/2010 |
| EP | 2154585 | B1 | 2/2010 |

OTHER PUBLICATIONS

S. Ruthetford, "Miniature Sputter-Ion Pump Design Considerations," NASA/JPL, pp. 1-15, 1999.

J. Z. W. G. Marcin Bober, "Designing Zeeman slower for strontium atoms—towards optical atomic clock," arxiv, 2010.

K.W. Ormond, Design of a Vacuum Syste.m for a Compact, High Luminosity CESR Upgrade, Cornell University, 2001.

S.a.Y.B, Gianchandani, "Miniature Penning Cell Array or On-Chip Vacuum Pumping," Ann Arbor, Michigan.

P. Cheiney et al., "A Zeeman slower design with permanent magnets in a Halbach configuration", Review of Scientific instruments, 82, 2011.

* cited by examiner

COLD-MATTER SYSTEM HAVING ION PUMP INTEGRATED WITH CHANNEL CELL

This application is a continuation-in-part of co-pending U.S. patent application Ser. No. 14/466,711, filed 2014 Aug. 22, and claims the benefit of that filing date. This application further claims priority from U.S. Provisional Application 61/902,665 filed 2013 Nov. 11. The priority applications are incorporated herein by reference.

BACKGROUND

Cold-matter (including ultra-cold-matter) physics (e.g., optical traps, magneto-optical traps (MOTs), ion traps, laser cooling, and Bose-Einstein Condensates), has spurred demand for compact high vacuum (HV) and ultra-high vacuum (UHV, e.g., from about $10^{-9}$ torr to about $10^{-13}$ torr) systems. Various pumping technologies can be used to establish UHV. However, UHV can degrade as particles are introduced intentionally (e.g., as part of an experiment) or unintentionally (e.g., by effusion from or diffusing through vacuum cell walls), so an active pumping technology is needed to maintain UHV. Ion pumps are currently the most desirable and mature technology for actively maintaining UHV in a compact cell. Typically, an ion pump is attached directly or via some intermediate structure to a cell that is to contain the cold matter.

UHV systems are typically incorporated in host systems that, for example, may include equipment for maintaining the UHV system in a high-vacuum (HV) environment, lasers, and other equipment for interacting with the content of interest in the UHV cell. Accordingly, typical UHV host systems are desktop-size or larger and, so, tend to be expensive and immobile. What is needed is a relatively small, inexpensive, and robust UHV system (including a UHV cell and an ion pump) that could be incorporated into a compact and, preferably, portable host system. Such a UHV system and host system would make cold and ultra-cold-matter systems accessible to more people, which in turn would stimulate advances in and expand applications of cold-matter physics.

DETAILED DESCRIPTION

The present invention provides an economical, compact, and robust ultra-high-vacuum (UHV) channel cell including particle cooling components and an integrated ion pump. The channel cell includes a GCC (glass and/or ceramic and/or crystalline) body that is monolithic in the sense that it is formed by removing material from a block of material, e.g., as opposed to being assembled from separate components. Sites from which material is removed serve, when covered, as chambers for particle cooling and for ion pumping. Particular challenges involved in the manufacture and use of the inventive UHV channel cell are addressed, at least in part, using a getter material as a pressure regulator and frit-bonding to interior walls of the GCC housing polished panels to serve as reflectors or bonding sites.

Figure 1:
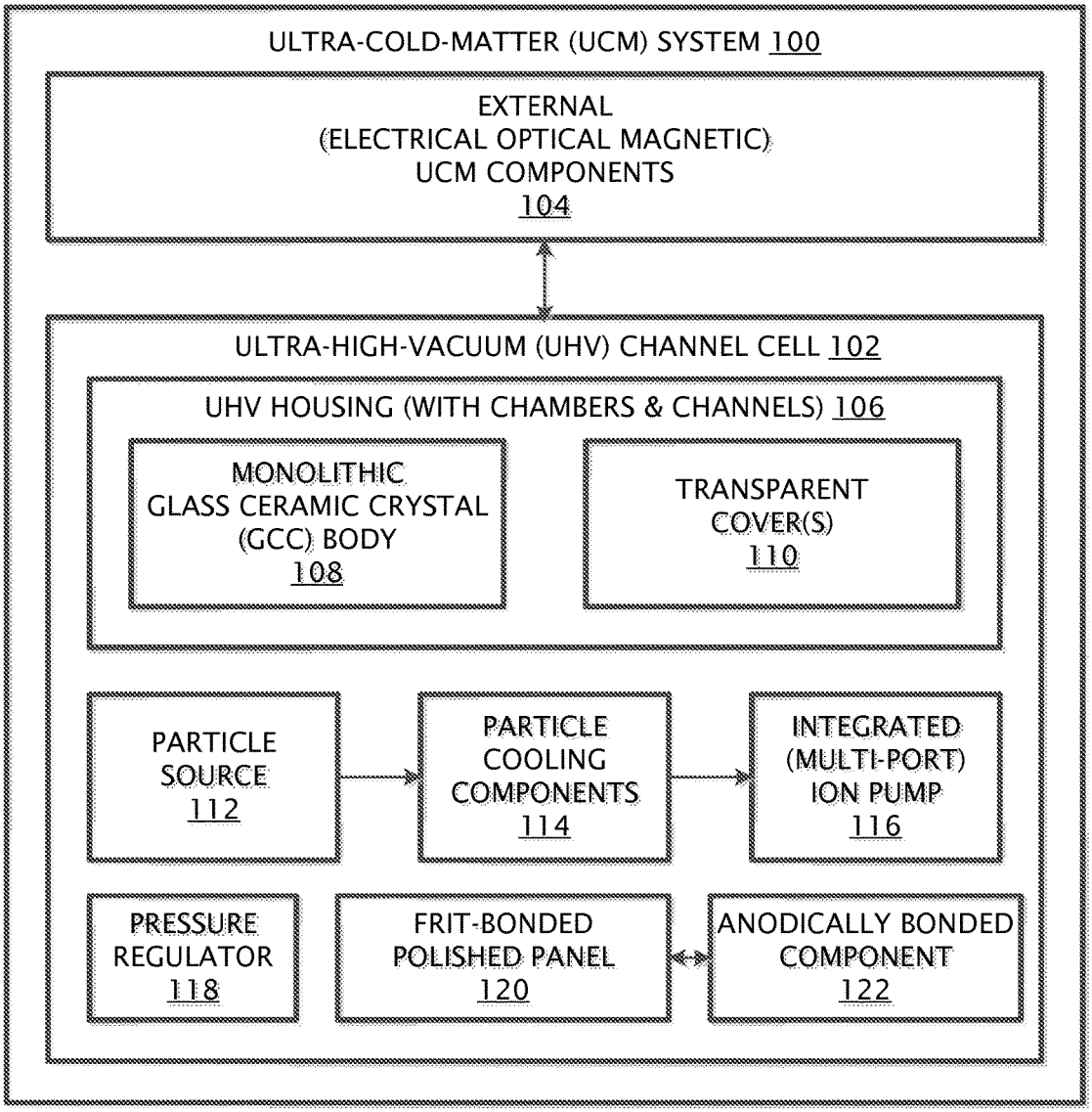
FIG. 1 is a block diagram of a cold-matter system in accordance with the invention.

An ultra-cold-matter (UCM) system 100, shown in FIG. 1, includes an ultra-high-vacuum (UHV) channel cell 102 and external (to the channel cell) UCM components 104. UHV channel cell 102 includes a UHV housing 106 having a monolithic GCC body 108 and transparent covers 110. Together, body 108 and covers 110 define chambers and at least one channel connecting the chambers. The chambers contain a particle source 112, particle cooling components 114, an ion pump 116, and a pressure regulator 118. UHV housing 106 includes a polished panel 120, e.g., of silicon, that is frit-bonded to an interior wall of GCC body 108. The particle source 112 and the pressure regulator 118 are anodically bonded to a polished surface of polished panel 120.

External UCM components 104 can include electrical, optical, and magnetic components. Electrical communication with the interior of the channel cell can be provided using integrated circuit vias and feedthroughs. Optical access (e.g., for lasers and illumination detectors) can be had through a transparent cover. External magnets can provide and/or affect magnetic fields within housing 106.

GCC body 108 can be formed from a block of silicon. Transparent covers 110 can be formed, for example, of glass (e.g., sodium borosilicate glass), ceramic (e.g., Zerodur®), or crystal (e.g., sapphire). The particle source can include a solid or liquid rubidium module, which releases rubidium vapor. Rubidium is liquid at 60° C., we bond at 300° C.+, so ampoules can be used making a trapped liquid viable. The particle cooling components can include a magneto-optical trap (MOT), an optical trap, or another type of atom trap. The integrated ion pump can include a plug-in electrode assembly; for example, the assembly can provide one or two cathodes and an anode. Alternatively, a wall of GCC body 108 can serve as an anode for ion pump 116; in that case, an assembly with two cathodes and no anode can be plugged into the ion-pump site. The ion pump can have a single port to one chamber or separate ports to two or more chambers of housing 106. In an amendment, there is one field emitter array in addition to or replacing at least one component of the penning ion pump to reduce magnetic field requirements or enhance low pressure stability.

Pressure regulator 118 can include getter material(s). For example, carbon and/or gold can be used to absorb rubidium. Carbon tends to have more capacity for absorbing particles than gold, while gold responds more quickly as a getter. Carbon and gold getters can be used together to combine their advantages. When the amount of particles is excessive, the regulator can sorb more particles than it releases; when the amount of particles is insufficient, the regulator can release more particles than it sorbs.

A cold-particle method comprising: releasing particles from a solid phase to a vapor phase, the releasing occurring within the bounds of a monolithic block of GCC material from which GCC material has been removed to form sites and channels, the GCC material consisting essentially of glass, ceramic, or crystalline material; regulating an amount of particles in vapor phase using at least one material that sorbs and desorbs the particles; cooling the particles using at least one magneto-optical trap located within the bounds of the monolithic block; and sorbing at least some particles using a Penning trap of an ion pump, the Penning trap extending at least part way through the bounds of the monolithic block.

Figure 2:
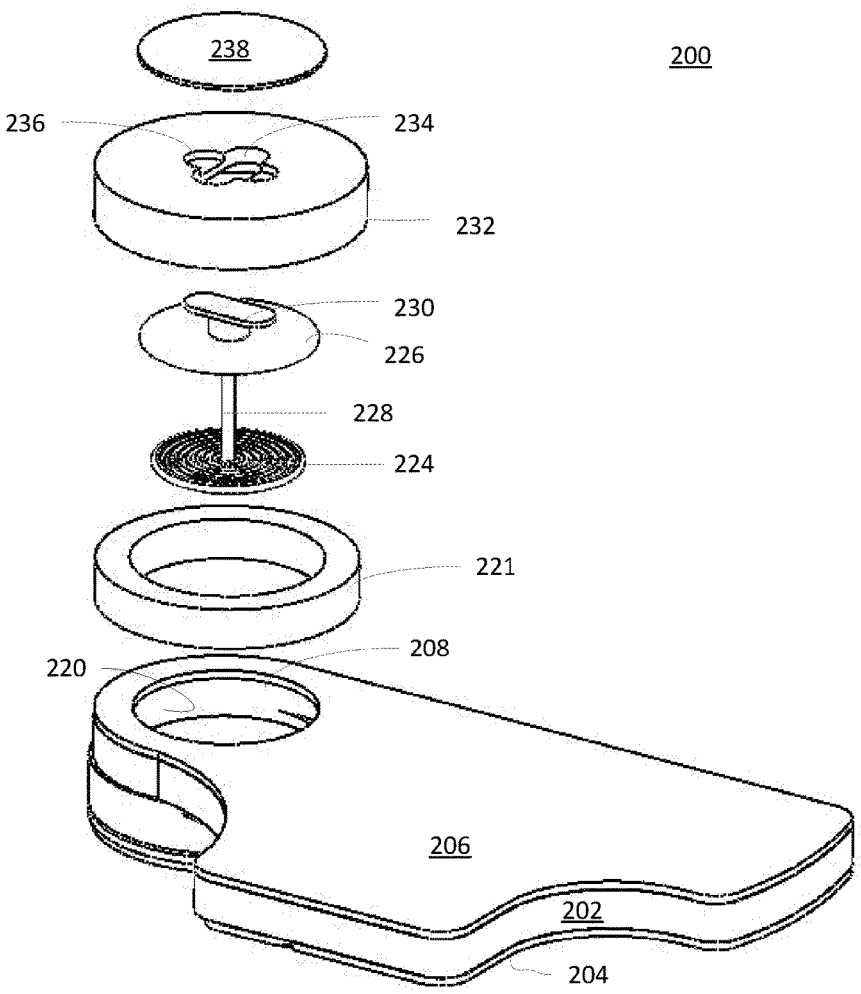
FIG. 2 is a top exploded diagram of an integrated plug-style ion pump in a channel cell in accordance with the invention.

Another UHV cell 200 is shown in the exploded diagram of FIG. 2. Cell 200 includes a monolithic crystalline body 202, a base cover 204, and a top cover 206. Covers 204 and 206 are transparent sheets of sodium borosilicate or boro-aluminosilicate glass. As can be discerned from FIG. 2, body 202 includes an aperture 208 that serves as a site for an ion pump, to be discussed further below.

A cold-particle method as recited in claim 1 further comprising ushering the particles from a chamber containing the solid phase through an aperture of a polished panel frit-bonded to an unpolished GCC wall, through a channel coated with getter material, and into a chamber including the at least one magneto-optical trap.

A source-pump vacuum-conductance channel 320 extends from source chamber 312 to ion pump 310. During normal operation, source-pump channel 320 is closed so that the particle pressure in source chamber 312 is higher than the particle pressure in cooling chamber 314. However, an aperture 322 can be actuated in a slot 324 to open source-pump channel 320, e.g., to achieve a lower pressure during initial vacuum processing and during maintenance pump out.

In an alternate embodiment, the valve may be cylindrical or spherical with a conductance slot or hole, occupying a sufficiently conformal pocket or feature such that gravity or inertial effects minimally affect the valve position. Such a valve may be inertially, electrostatically, or magnetically actuated. A further alternative embodiment uses a bimetallic valve or coil to actuate an aperture to the conductance channel. In such an embodiment, the valve is typically open at high temperatures used for UHV processing and closed at lower operational temperatures to maintain internal pressures in separate chambers or cavities.

Figure 4:
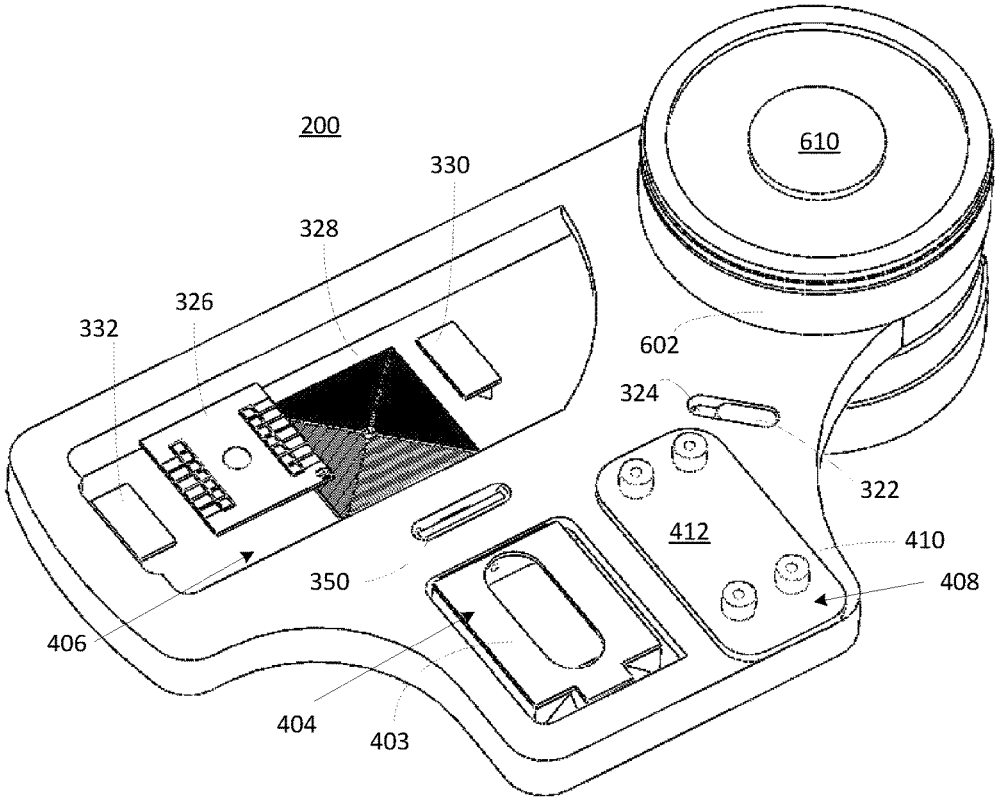
FIG. 4 is a bottom perspective view of the channel cell of FIG. 2.

Cooling chamber 314 includes a site for an atom chip 326. Atom chip 326 can be used, for example, to create (from cold particles), control, and monitor a Bose-Einstein condensate. Atom chip 326 (such as the atom chip disclosed in U.S. Patent Publication U.S. Pat. No. 7,126,112 B2) includes vias that allow electrical communications between the interior and the exterior of channel cell 200, as indicated in FIG. 4, which shows channel cell 200 with base cover 204 removed.

Pre-cooled particles are cooled by a magneto-optical trap (MOT) established using a two-dimensional diffraction grating 328.

A two-dimensional diffraction grating permits a magneto-optical trap to be established using a single laser. The laser can be external to channel cell 200. The laser beam can be directed through transparent top cover 206 (FIG. 2) and redirected using reflectors 330 and 332 (FIG. 3) to form the MOT at diffraction grating 328. In an alternate embodiment, the diffraction grating may be patterned topographically onto silicon or sodium alumina-silicate glass and anodic bonded to the inside of the chamber to reduce optical losses to reflection and minimize cell volume. Further, dielectric coatings may be used to maximize diffraction efficiency, especially on blazed topographically patterned diffraction gratings.

The particles that the MOT cools are provided from source chamber 312. Source chamber 312 houses a particle source 334 of solid-phase material that can release or be stimulated to release, as a vapor phase, particles of interest, e.g., rubidium atoms, other alkali or alkaline atoms, or other particles of interest. Source chamber 312 is held at a higher pressure than cooling chamber 314 to enable faster loading of the pre-cooling MOT for a higher flux of pre-cooled atoms into the cooling chamber 314.

Particle source 334 is mounted on a source plate 412 (FIG. 4). In an alternative embodiment, a particle source may be attached to a polished panel frit-bonded to an interior wall of source chamber 312. Mounting components on a plate allows for recycling of channel cell 200 by removing the source assembly and replacing it with another. In another embodiment, a particle source may be mounted on a base cover. Particle source 334 may be optically or electrically stimulated to release particles. For example, an external power source can be connected to particle source 334 using electrical feedthroughs 410 (through source plate 412), or stimulated optically using lasers with beams passing through transparent top cover 206, or be heated using electrical inductive heating through the GCC material. However, it can be difficult to precisely control the amount of particles released due to the stimulation. Too many or too few particles can interfere with the production of cold atoms. Furthermore, GCC materials are arranged in proximity to inductively operated components according to their conductive, semi-conductive, or non-conductive natures. Conductive materials, such as highly doped silicon, may be included to shield, absorb, or otherwise interact with the radio frequency (RF) or inductive energy. For example, it may be advantageous to have the silicon near the particle source or getter heat as the element heats to reduce thermal gradients or increase local vapor pressure. Conversely, it may be desirable to use less conductive material, or use undoped material, to confine RF heating to just the element being targeted. In this way, material choice is synergistic with the intended method of heating, processing, and operating the UHV cell.

A carbon getter 336 and a gold getter 338 are provided to regulate the amount of free particles in source chamber 312. Getters 336 and 338 may be mounted on source plate 412 to constitute source assembly 408, which can be replaced to provide fresh source and getter materials. Carbon getter 336 has a greater capacity for absorbing rubidium, while gold getter 338 can absorb rubidium more quickly. While getters are designed primarily to sorb particles, getters also desorb (release particles) as they become saturated. When the vapor concentration of particles is high, getters tend to absorb more than they release; when the vapor concentration of particles is low, getters tend to release more particles than they absorb. The equilibrium points (vapor concentrations at which the rate of particle absorption equals the rate of particle release) can be adjusted by adjusting the temperatures of the getters or by applying and withholding optical (e.g., laser) stimulation or electrostatic fields. Thus getters 336 and 338 provide for regulated particle vapor concentrations, with the gold getter providing for rapid response to deviations, and the carbon getter providing greater capacity. In this sense, carbon getter 336 and gold getter 338 collectively constitute a particle pressure regulator.

In alternative embodiments, pressure regulation can be provided using a single getter material, e.g., only carbon, only gold, or only some other material appropriate for the type of particle of interest. In such an alternative embodiment, the getter may further be pre-loaded with the particle of interest in a large batch process, sealed and singulated for installation into numerous chambers in part of a manufacturing process, typically under an inert or buffer gas to reduce contamination and reaction of the stored materials. Such sealing may incorporate encapsulation of the surface with a passivation layer such as gold, indium, or even an oxide or nitride of the contained species or particle of interest, thereby protecting the internal reservoir from contamination during the getter transfer. The sealing layer is subsequently blown off, cracked, or evaporated once the new chamber is complete and evacuated.

A polished panel 341 cooperates with other reflectors 342, 343, and 344, an external laser, and magnetic fields to define a pre-cooling MOT that traps free particles and pushes them toward cooling chamber 314. Reflectors 342, 343, and 344 may be pre-aligned on a substrate 403, and the resulting pre-cooling MOT assembly can be installed in cell 200, as indicated in FIG. 4.

Figure 3:
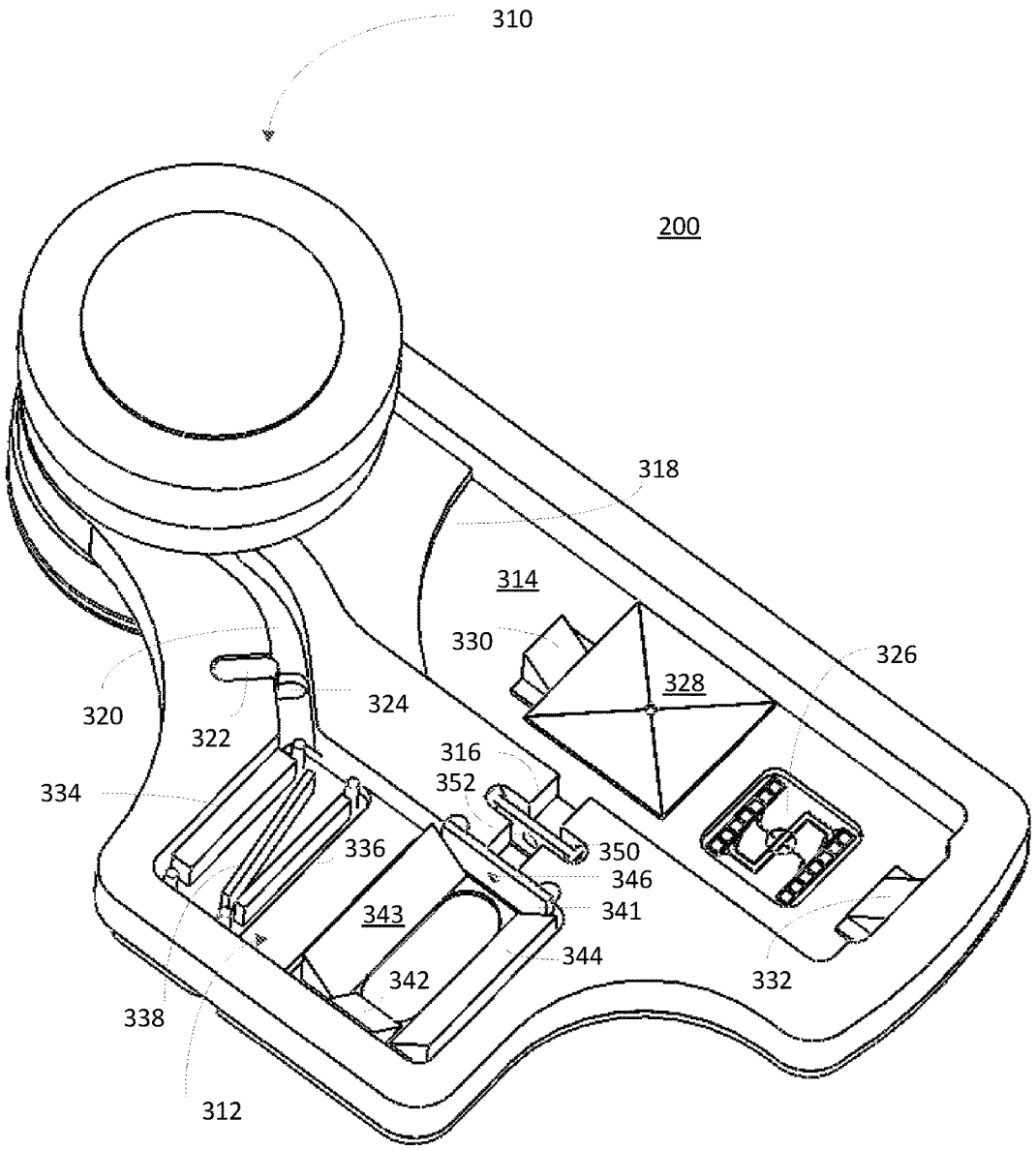
FIG. 3 is a top perspective view of the channel cell of FIG. 2.

Collimated pre-cooled particles can enter cooling (aka, "science") chamber 314 via source-cooling channel 316, as indicated in FIG. 3. Polished panel 341 includes a pinhole aperture 346 that permits on-axis particles to pass, while blocking off-axis particles, including thermal (insufficiently pre-cooled) particles back through the pre-cooling MOT. Polished panel 341 is used to retro-reflect a 2D push beam that guides pre-cooled atoms between chambers 312 and 314.

Figure 5:
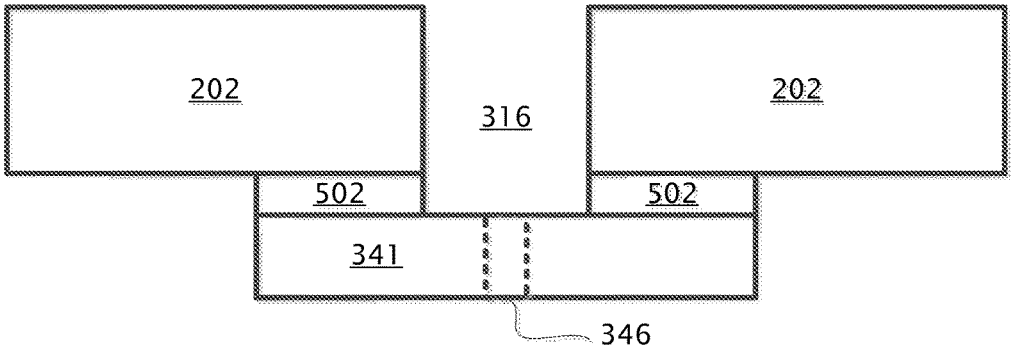
FIG. 5 is a schematic diagram of a polished panel frit-bonded to an interior wall of the channel cell of FIG. 2.

Polished panel 341 can be frit-bonded to an unpolished interior wall of body 202. This low-cost solution uses a frit material such as a 200 μm thick layer 502 (see FIG. 5) of sodium borosilicate glass to melt at high temperature so as to conform to the ground surface of the channel cell's silicon side wall and the polished or unpolished back side of the polished silicon plate. The frit layer may be pre-bonded via anodic or direct bonding to the GCC or silicon polished panel 341 and then both parts may be machined or formed as a single component prior to the frit process. Due to the low surface area of the bond and the close CTE match of the sodium borosilicate glass to silicon, a properly thermal cycled part imparts a low stress so that it minimally affects the flatness of the silicon plate.

As shown in FIG. 3, a bulk getter panel 350 with an aperture 352 is used to trap thermal particles that make it through pinhole aperture 346. Panel 350 can be carbon, in which case it can be thermally isolated from the chamber with low thermal conduction standoffs to minimize the power required to de-gas and activate the getter material during initial vacuum processing. Additional gettering of thermal particles can be achieved by coating the walls of source-cooling channel 316. Coatings may include gold, bismuth, antimony, and other materials known to getter thermal species that are escaping the chamber. These measures are taken to minimize the presence of thermal particles in cooling/science chamber 314.

Figure 6:
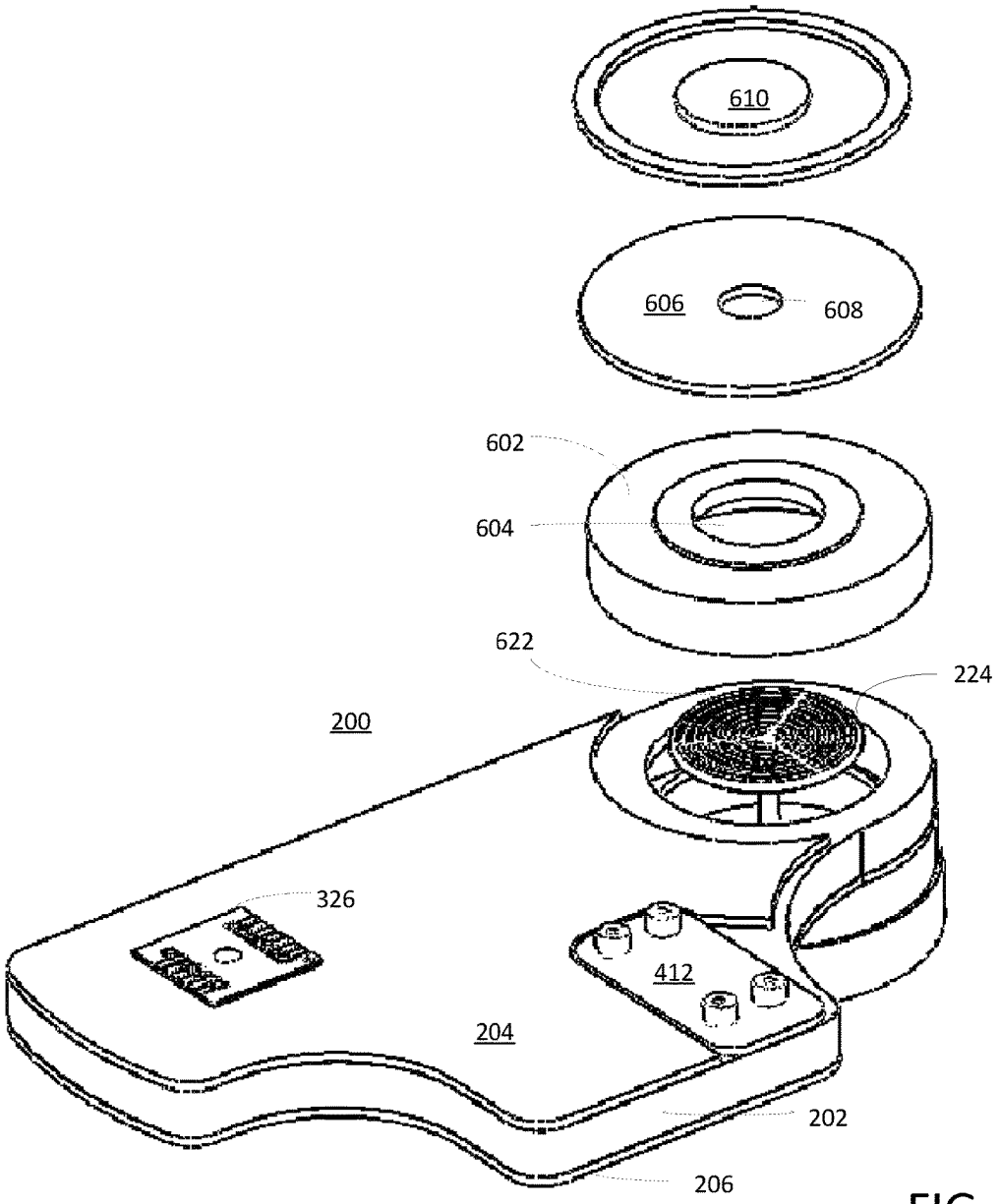
FIG. 6 is a bottom exploded diagram of the pump-out port and ion-pump cap of a channel cell in accordance with the invention.

Ion pump 310 (shown in FIG. 3) includes several components best seen in the exploded diagrams of FIGS. 2 and 6. Ion-pump aperture 208 has an ion-pump aperture wall 220 that serves as an anode for ion pump 310. The silicon of body 202 can have been doped to render it conductive prior to formation of ion-pump aperture 208. Alternatively or in addition, doping can be implemented after aperture 208 is formed. In addition, a conductive coating can be applied to ion-pump aperture wall 220 to render it conductive prior to initial use. During operation of the ion pump, additional conductive material, e.g., titanium sputtered from cathodes may coat the anode. An anode extension 221 provides for a greater anode height than would be provided by body 202 alone.

The anode extension and bonded joint are designed such that sputtered conductive material, e.g. titanium, will improve anode electrical uniformity by forming a continuous coating between anode and extension over the bond joint thereby improving performance as the ion pump ages while minimizing pre-assembly process steps to apply conductive coatings. In such a case, an initial coating can be applied in an ion-pump firing, or operation, early in vacuum processing while pressures are still sufficiently high ($10^{-8}$ to $10^{-4}$ torr) to result in electrically significant conductive coatings in reasonably short periods of time. In an alternative embodiment, an anode extension is not used.

Ion pump 310 includes a cathode assembly 622 (FIG. 6), that includes components shown in FIG. 2: a 3D-printed cathode 224 with slots and an unslotted cathode 226, both mounted on a shaft 228. A cathode feedthrough 230 to provide electrical power to the cathodes is mounted at one end of shaft 228. Cathode assembly 622 is "pre-assembled" in the sense that it is assembled prior to insertion into ion-pump aperture 208. An ion pump that is formed in part by inserting a pre-assembled electrode structure including two or more electrodes is referred to as a "plug-style" ion pump. In other embodiments, a pre-assembled electrode assembly can include an anode along with one or more cathodes. In a non-plug-style embodiment, electrodes are placed in position individually.

Slotted cathode 224 is suspended by support shaft 228 such that it floats within the pump/channel cell without shorting to the walls of the anode. The slots serve to lower the mass of the plug structure, improving its resistance to shock and vibrations, improving vacuum conductance from the channel cell to the pump-out port, and increasing grazing incidence collisions of ionized species to improve noble-gas pumping. Plug-solid (unslotted) cathode 226 acts as a shadow mask to prevent sputtered material from shorting the anode to the cathode feedthrough 230 by masking the inner face of the insulating glass cap 232.

Ion pump 310 (FIG. 3) includes a cap 232 (FIG. 2) with an elongated aperture 234 to allow cathode feedthrough 230 to pass through. Cap 232 also includes an elongated recess 236 that extends orthogonal to elongated aperture 234. Once it is extended through aperture 234 during assembly of channel cell 200, cathode feedthrough 230 can be rotated and seated flush in elongated recess 236. The seated feedthrough 230 can then be covered and sealed with a top cap 238.

In another embodiment, the plug-solid cathode 226 has no protruding standoff/feedthrough 230. Instead, cathode 226 is captured and in direct contact with insulating glass cap 232 and conductive top cap 238. Shadow mask features are formed into the inner diameter surface of the insulating glass cap 232 (as per Provisional Patent 61/902,665 filed previously). These shadow mask features prevent direct sputtering to at least one region of glass cap 232, thus preventing shorting between the cathode and anode structures.

In an alternative embodiment, a field emitter element replaces at least one component of the ion-pump assembly to improve low pressure ion pump stability or reduce required magnetic fields. The array may be used in field emission mode to inject electrons into the active pumping area, or field ionization mode to directly ionize and introduce ions into the active pumping area. Shadow mask features and geometries must be used (as per U.S. patent application Ser. No. 14/466,711) to protect the emitters from back-sputter and shorting.

As indicated in FIG. 6, ion pump 310 includes a pump cap 602 with an aperture 604. Pump cap 602 provides an internal pocket large enough to leave a gap between the inner surface and the cathode assembly 622. Channel cell 200 is pumped out through aperture 604 during vacuum processing. A disk 606 with an aperture 608 smaller than aperture 604 is used to evacuate cell 200. After evacuation, ion pump 310 is sealed in vacuum using a cap 610. Cap 610 may be anodically bonded to disk 606. Alternatively, another method of contact or direct bonding can be used, such as transient liquid phase (TLP) diffusion bonding, or others of sufficient quality for UHV compatibility and high-temperature processing.

Particle source 334 and getters 336 and 338 (FIG. 3) are mounted on a source plate 412, shown in FIG. 6 to yield source assembly 408 (FIG. 4). As shown in FIG. 6, removable source plate 412 is not covered by base cover 204. This allows the resulting source assembly 408 to be installed near the end of the formation of cell 200. In addition, source assembly 408 can be removed, and replaced to refresh cell 200 without removing cover 204; in the process, the source and getters are replaced. Components covered by base cover 204 are shown in FIG. 4. These include a pre-cooling MOT assembly 404, aperture 322, bulk getter panel 350, cooling MOT assembly 406, and bases of reflectors 330 and 332.

Figure 7:
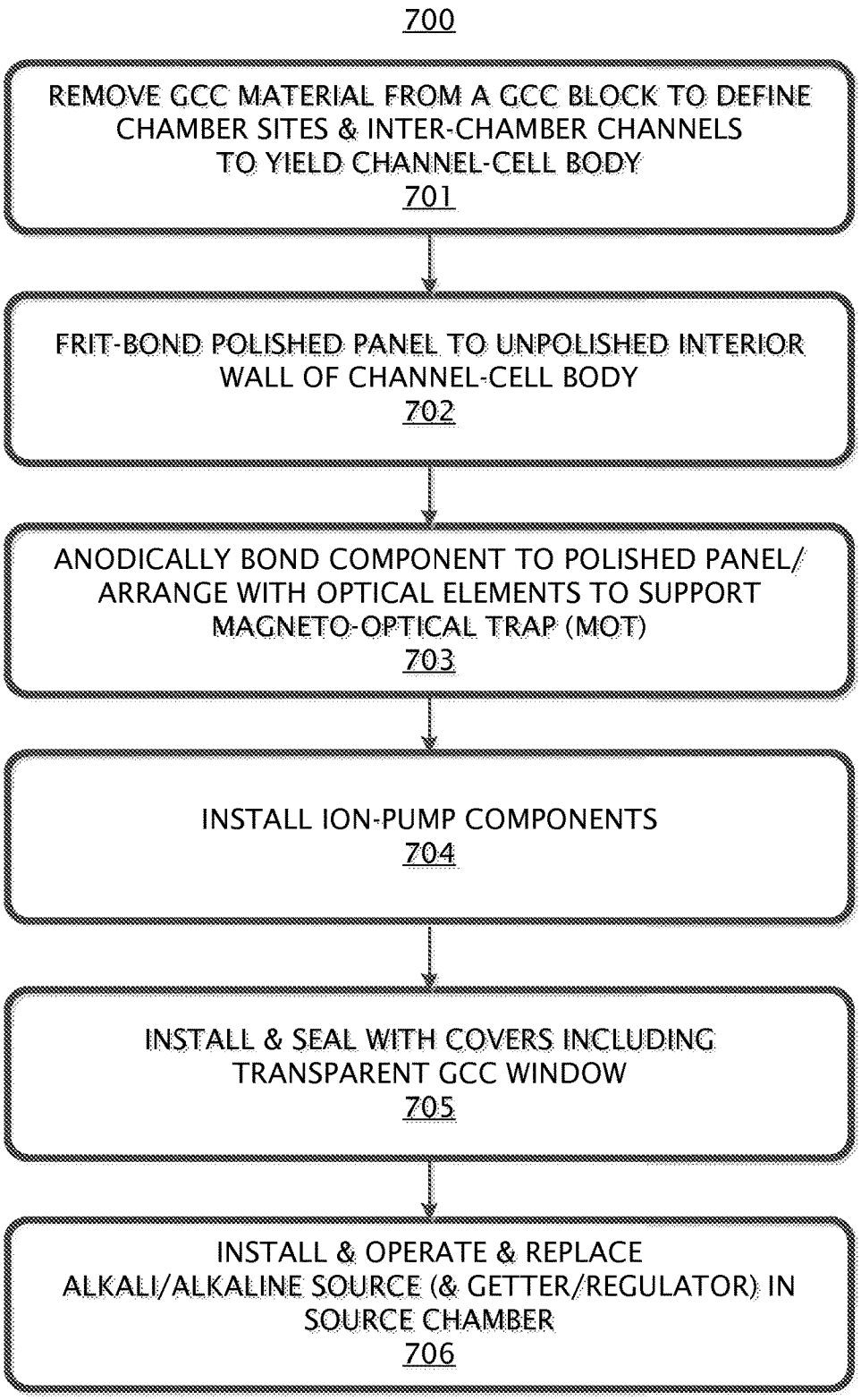
FIG. 7 is a flow chart of a process of manufacturing a channel cell in accordance with the invention.

A process of manufacturing a channel cell is flow charted in FIG. 7. At action 701, GCC material is removed from a GCC block to define chamber sites and inter-chamber channels to yield a channel-cell body. The chamber-sites are the locations of chambers, the boundaries of which are defined in part by the channel-cell body and in part by covers attached to the channel-cell body.

At 702, a polished panel is frit-bonded to an unpolished interior (chamber) wall to provide a polished surface for use as a reflector or as a bonding site. Typically, at 701, material is removed by machining. The walls at the boundaries of the volumes from which material is removed are typically unpolished. Polishing the interior walls can be expensive, requiring special tools and procedures. The costs associated with polishing interior walls can be avoided by bonding polished panels, as needed, to the unpolished chamber walls. The frit-bonding uses a glass layer that is fused at high temperature to the unpolished chamber wall and to one (polished or unpolished) surface of the polished panel. Due to the high temperatures involved, the polished panels are frit-bonded before heat-sensitive components are installed in the channel-cell body.

At 703, further actions are taken, depending on the intended purpose of the polished panel. For example, a component may be bonded to the polished panel. Anodic or another form of relatively low-temperature contact bonding can be used to bond even heat-sensitive components, such as source material, getter materials, etc. Alternatively, optical elements can be arranged in the channel-cell body to cooperate with the polished panel to define optical paths used in an optical or magneto-optical trap.

At 704, ion-pump components are installed. This can include installing a plug-style electrode assembly, e.g., an electrode assembly for which the electrodes (cathodes or anode and cathode(s)) assembled to form a plug-in module prior to installation in the channel-cell body.

At 705, covers can be bonded to the channel-cell body to seal chambers. Transparent covers or covers with transparent windows can be used over MOTs and other regions to provide (e.g., to external components) optical access to components within the channel-cell body.

At 706, a solid-phase source is installed in a source chamber in the channel-cell body. As in channel cell 200, the source can be installed as part of an assembly including getter/regulators after the covers are in place. The covers are arranged not to block the site at which the source assembly is installed. This makes it possible to replace the source assembly after a period of channel-cell operation, with a new assembly with a fresh source and fresh getter material. In an alternative embodiment, a source or a getter is attached by contact bonding to the polished panel at 703. In another embodiment, the source is installed before the covers are attached.

Figure 8:
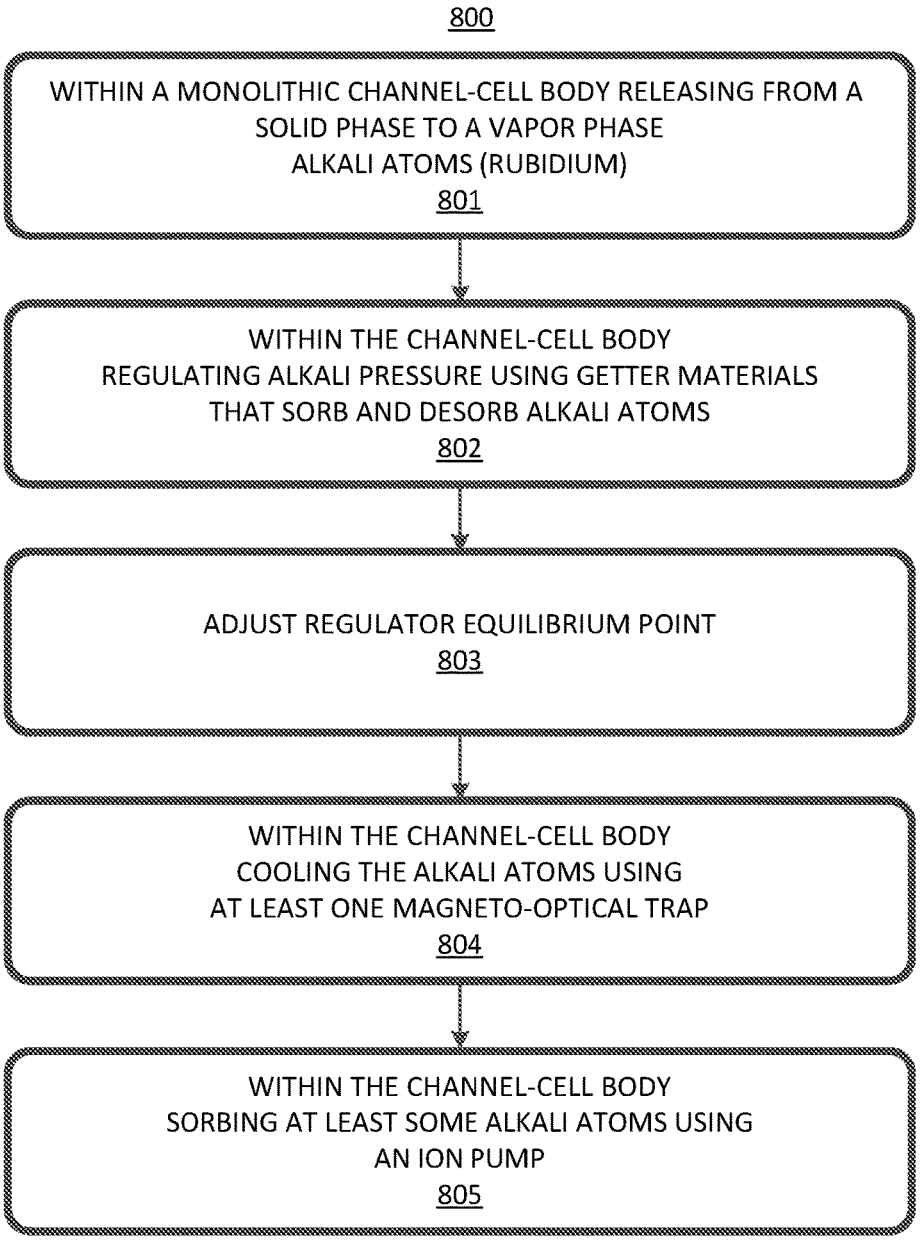
FIG. 8 is a flow chart of a process of using a channel cell in accordance with the invention.

A process 800 of using a channel cell is flow-charted in FIG. 8. At 801, within a channel-cell body, alkali atoms, e.g., rubidium atoms, are released from a solid-phase to a vapor phase. At 802, getter materials within the channel-cell body regulate the alkali pressure using getter materials that sorb and desorb the alkali atoms. At 803, an equilibrium point between sorption and desorption of the alkali atoms is adjusted. This can involve changing a temperature, e.g., using resistive heating, of the getter materials, electrically stimulating the getter material, and/or optically stimulating the getter material. For example, a common laser pointer can generate a beam that is transmitted through a transparent cover of the channel cell to impact the getter material, which is thus optically and/or thermally stimulated to increase the rate of release of gettered alkali atoms.

At 804, alkali atoms are cooled, i.e., using a MOT, plural MOTs, an atom chip, or other structure. Further manipulation, treatment, or study can be conducted once the atoms are cooled. At 805, thermal atoms (e.g., ones that were not sufficiently cooled and formerly cooled atoms that are to be evacuated), may be conducted to an ion pump so that at least some alkali atoms are sorbed to or into a wall of the channel-cell body. Note that replacement of the source and getters may be affected as described above at 706 of process 700.

As is apparent from the foregoing, the present invention provides for a compact, robust, and economical channel cell with an integrated ion pump. Alternative embodiments provide for channel cells with a single particle chamber and with two or more particle chambers. The channel-cell housing can be fabricated of different GCC materials. The components installed in the chambers and channels can vary according to the application of the channel cell.

Herein, "ion pump" refers to any system that removes mobile molecules (including single-atom molecules) from a local (incomplete) vacuum by: 1) ionizing the molecules to yield ions; and 2) immobilizing the ions by sorbing (adsorbing or absorbing) them to a "getter" material. Herein, "molecule" refers to the smallest particle in a chemical element or compound that has the chemical properties of that element or compound. A typical ion pump makes use of a Penning trap constituted by: an electric field and a magnetic field. The electric field gives rise to free electrons at a cathode and accelerates them toward an anode. A cross product of the magnetic field with the current associated with the accelerating electrons produces a force orthogonal to the electron path. This force diverts the electrons so that they form a swirling cloud.

The resulting cloud of swirling electrons ionizes incident atoms or molecules, which are then accelerated by the electric fields so that they impact surfaces of getter material, to which the ions are adsorbed. In addition, some molecules, e.g., of hydrogen and noble gases, most significantly, helium, may be captured by the getter material. In a "sputter ion pump", getter material may be liberated ("sputtered") from the getter surface and then re-deposited, burying sorbed molecules and renewing the getter surface. In contrast to other common UHV pumps, such as turbomolecular pumps and diffusion pumps, ion pumps have no moving parts and use no oil. They are therefore clean, need little maintenance, and produce little or no vibrations.

Herein, "GCC" stands for "glass-ceramic-crystal" and characterizes materials predominantly constituted by one or more of glass, ceramic, and crystalline materials. Examples of GCC materials include various silicate glasses, Zerodur® ceramic, and monocrystalline silicon. ZERODUR® is, a registered trademark of Schott AG, and refers to a lithium aluminosilicate glass-ceramic Herein, "bond" means "join or be joined securely to something else", either using an adhesive or other intermediate layer or using a contact bonding process. "Contact bonding" refers to bonding in which the objects to be bonded are in direct contact, e.g., without an intermediate adhesive layer. "Direct bonding" is a form of contact bonding involving the lateral annihilation by Van der Waals forces of two surface layers of two separate non-plastically deformable objects. "Fusion bonding" is a form of contact bonding involving a cohesive/adhesive joining of two solid bodies clamped together or even direct bonded, and annealed at an elevated temperature up to an atomic mobility level at which the reconstructed surface layers of the two elements are chemically (covalently) united. "Anodic bonding" is a form of contact bonding in which at least one of the surfaces has a component that is influenced by an electric field such that coalescence or diffusion takes place at an annealing temperature under influence of an electric field. "Vacuum bonding" involves the contact bonding of two solid objects under vacuum conditions so that dangling bonds are united. "Frit-bonding" is a non-contact bonding process which involves fusing each of the objects to an intermediate object or layer (the "frit", typically glass).

"Smallest convex envelop" for an object is the smallest convex shape that can completely enclose the interior of the object. For a rectangular parallelepiped, the smallest convex envelop would be a rectangular parallelepiped even if apertures and recesses were formed in the object.

"Sorb" encompasses "adsorbing", e.g., to a surface, and "absorbing", e.g., into a volume of material. "Desorb" means to release, e.g., sorbed atoms or other particles.

Herein, a "housing" is a structure that at least substantially encloses or is designed to at least substantially enclose functional components. An "ion-pump housing" is a housing that at least substantially encloses or is designed to substantially enclose a Penning trap; an ion-pump housing may also at least substantially enclose components used to implement a Penning trap.

Herein, a "housing interior" is a volume completely enclosed by a smallest convex shape containing the housing less the housing itself. A functional component is substantially enclosed by a housing if it is contained in the housing interior or is part of or formed on a wall of the housing that contacts the housing interior. "Ion-pump interior" refers to the interior of an ion-pump housing plus any volume in fluid communication with the housing interior, excluding the interior of an attached UHV cell.

Herein, "GCC material" encompasses glass, ceramic, and crystalline materials as well as composites of these materials; herein, "metal alloys" are not "GCC materials". Herein, "glass" refers to an amorphous oxide material that can undergo a transition between a hard and relatively brittle state into a molten or rubber-like state. Examples of glass include sodium borosilicate glass, alumino and boro-alumino silicate glass, other silica glasses containing at least 50%, by weight, silica, and alumina glasses containing at least 50%, by weight, alumina. "Ceramic" encompasses structures formed by sintering or otherwise bonding together particles of inorganic, non-metallic oxides (e.g., silica, alumina), carbides, borides, nitrides, and silicides. Herein, "crystalline" refers to a structure formed from a single crystal or "boule". The crystal may be an insulator such as zirconia, sapphire, or aluminum oxynitride, or a semiconductor such as silicon, germanium, gallium arsenide, or indium arsenide. GCC can further encompass any combination of the above; for example, Zerodur® is a GCC material that includes an aluminosilicate glass with alumina crystals). Herein, "consisting predominantly of" means "at least 90% by weight".

Herein, an "electrode" is an electrically conductive circuit component used to make contact with a non-conductive circuit component. In the present context, the non-conductive circuit component is a UHV. Herein, "anodes" and "cathodes" are electrodes configured such that an anode has or can have a positive electrical potential relative to the electrical potential of an associated cathode, which has or can have a negative electrical potential relative to the anode. In the context herein, electrodes are designated "anode" or "cathode" according to the relative electrical potentials that must be applied to them to axially confine a Penning-trap electron cloud, while a sub-cathode or other such electrode may have a potential positive or negative relative to any previously established anodes or cathodes. Herein, "axial", "radial", and "circumferential" refer to three orthogonal dimensions of a cylindrical coordinate system in which "axial" refers to the direction of a magnetic field through a Penning trap used to confine the electron cloud "radially".

Herein, a "Penning trap" is a combination of magnetic and electric fields used to confine an electron cloud. Typically, a homogeneous axial magnetic field is used to confine electrons radially, while a spatially varying electric field is used to confine electrons axially. Herein, "particles" encompasses atoms, molecules, and ions. "Transparent", "transmissive", and "opaque" are defined, by default, with respect to visible light. However, if a light source of a particular wavelength or wavelength range (e.g., ultraviolet (UV), gamma, Infra-Red (IR), and X-ray) is mentioned, context may indicate that "transparent", "transmissive", and "opaque" are to be interpreted relative to the specified wavelength, wavelength range, or radiation type.

Herein, "three-dimensional (3D) printing" is an additive process of making a three-dimensional object by depositing material in successive layers. Herein, "getter" refers to a material included in a vacuum that has the innate ability to temporarily or permanently sorb chemically active species from vapor formed in a vacuum, thereby removing them from the background pressure, effectively pumping them from the system. Herein, "evaporable getter" refers to any getterable material intended to be evaporated onto a wall or surface in a vacuum to expose fresh sites for chemical adsorption. Herein, "non-evaporable getter" (NEG) refers to any getter material that is not to be evaporated, i.e., is to getter passively.

"Sputter" refers to an event wherein a collision by a free particle with sufficient energy causes one or more bound particles to become liberated. The liberation may be violent; the liberated particles typically fly by direct line-of-sight to impact and stick to a facing surface, thus coating said surface.

"Low He permeable materials": materials with helium permeation rates lower than borosilicate glass (at an operating temperature) by at least two orders of magnitude. Aluminum-oxide-based materials such as sapphire, Zerodur®, and alumino-silicate glass, as well as silicon crystal and many metals are examples of low He (helium) permeable materials. Zerodur® glass ceramic, made by Schott, is an anorganic, non-porous material, containing a crystallized phase and a rest glass phase. Zerodur® is made by a process of controlled volume crystallization.

Stable Penning operation occurs when the background pressure is sufficiently high to maintain a Penning discharge cloud of sufficient density as the mean free path for an atom incident upon the cloud has a high probability of electron collision and ionization, thereby contributing one or more of its electrons to the maintenance of the cloud and creating a sputter event that pumps gasses and also potentially contributes more atoms to the ionization events. Ion-pump instability occurs when pressure is so low that ionization events are infrequent enough that the electron cloud dissipates, terminating into the anode, at a rate higher than the ionization events. This ultimately leads to a depletion of the electron cloud and thus the pump becomes ineffective at further pumping until the cloud can be re-established. Ion-pump instability can be caused by a variety of factors including a low background pressure contributing atoms at an insufficient rate, conductive sputter or dendrites shorting the electrodes, insufficient magnetic or electric field strengths for Penning trap confinement, insulative or oxide layers formed over electrodes interfering with proper electric field generation, or misalignment of the magnetic field to the cell decreasing the electron lifetime in the cloud before anode termination.

Herein, "reformed" refers to any method of shaping or reshaping a material. The reforming method may involve high temperature, pressure, or chemicals. Herein, "growing" refers to any method whereby a chemical or a structure precursor is deposited, bonded, or otherwise permanently fused to an initial seed, scaffold, or base. The chemical or structure precursor may be in solution; the crystalline structure is often repeated based on the precursors present. The structure resulting from growing is said to be "grown".

"Machining" refers to any method of shaping and forming a complex shaped material from a simple bulk material. Machining may involve a mechanical removal, e.g., by cutting or grinding, but may include chemical removal, laser ablation, or a combination of the above. A structure resulting from machining is said to have been "machined".

Herein, a "vacuum cell wall" is any structure that defines a boundary between the inside, or vacuum side, of the vacuum chamber and the outside or ambient side of the vacuum chamber. Herein, an "ion pump" (also referred to as a "sputter ion pump") is a type of vacuum pump capable of reaching pressures as low as $10^{-11}$ mbar and beyond by ionizing gas contained within while employing a strong electrical potential, between 50V to 50 kV, which allows the ions to accelerate into and be captured by a solid electrode and/or its residue. Herein, "sorb" encompasses absorption and adsorption. In absorption, an absorbate fluid permeates or is dissolved by a liquid or solid absorbent. In adsorption, adsorbate particles adhere to the surface of an adsorbent. Adsorption is defined by the International Union of Pure and Applied Chemistry (IUPAC) as "Increase in the concentration of a substance at the interface of a condensed and a liquid or gaseous layer owing to the operation of surface forces."

Herein, all art labeled "prior art" is admitted prior art; all art not labeled "prior art" is not prior art. In the following claims, "said" refers to elements for which there is explicit antecedent basis, while "the" refers to elements for which the antecedent basis may be implicit. The foregoing embodiments, as well as modifications thereto and variations thereof, are within the scope of the following claims.

What is claimed is:

1. A cold-particle method comprising:

releasing particles from a solid phase to a vapor phase, the releasing occurring within the bounds of a monolithic block of GCC material from which GCC material has been removed to form sites and channels, the GCC material consisting essentially of glass, ceramic, or crystalline material;

regulating an amount of atoms in vapor phase using at least one material that sorbs and desorbs the particles;

cooling the particles using at least one magneto-optical trap located within the bounds of the monolithic block; and sorbing at least some particles using a Penning trap of an ion pump, the Penning trap extending at least part way through the bounds of the monolithic block.

2. A cold-particle method as recited in claim 1 wherein the particles are alkali-metal atoms and the material that sorbs and desorbs the particles includes at least one of carbon, gold, bismuth, and antimony.

3. A cold-particle method as recited in claim 1 further comprising ushering the particles from a chamber containing the solid phase through an aperture of polished panel frit-bonded to an unpolished GCC wall through a channel coated with getter material and into a chamber including the magneto-optical trap.

4. A cold-particle method as recited in claim 3 further comprising opening a pump-out conductance channel to the ion pump from the chamber containing the solid phase, pumping out the chamber containing the solid phase, and closing the pump-out conductance channel.

* * * * *